US009027784B2

(12) United States Patent
Knipe

(10) Patent No.: US 9,027,784 B2
(45) Date of Patent: May 12, 2015

(54) BEVERAGE CONTAINER LID WITH AN INCLINED LID FACE

(71) Applicant: Huhtamäki Oyj, Espoo (FI)

(72) Inventor: Stephen Knipe, Hayling Island (GB)

(73) Assignee: Huhtamaki Oyj, Espoo (FI)

( * ) Notice: Subject to any disclaimer, the term of this patent is extended or adjusted under 35 U.S.C. 154(b) by 0 days.

(21) Appl. No.: 14/179,939

(22) Filed: Feb. 13, 2014

(65) Prior Publication Data

US 2015/0076151 A1 Mar. 19, 2015

(30) Foreign Application Priority Data

Sep. 19, 2013 (DE) ..... 10 2013 218 866

(51) Int. Cl.
*B65D 43/02* (2006.01)

(52) U.S. Cl.
CPC ..... *B65D 43/0212* (2013.01)

(58) Field of Classification Search
CPC ..... A47G 19/2272; A47G 19/2205; B65D 2543/00046; B65D 2543/00092; B65D 47/06; B65D 2543/00537; B65D 2543/00481; B65D 2543/00546; B65D 2543/00296; B65D 43/0212; B65D 43/0204
USPC ..... 220/713, 711, 319, 315, 796, 784, 780, 220/794, 254.3
See application file for complete search history.

(56) References Cited

U.S. PATENT DOCUMENTS

| | | | | |
|---|---|---|---|---|
| 3,412,892 | A * | 11/1968 | Waksman et al. | 220/714 |
| 4,421,244 | A * | 12/1983 | Van Melle | 220/781 |
| 5,490,609 | A * | 2/1996 | Lane et al. | 220/712 |
| 6,612,456 | B1 * | 9/2003 | Hundley et al. | 220/254.3 |
| 6,889,859 | B1 * | 5/2005 | Leon | 220/254.3 |
| 7,992,741 | B2 * | 8/2011 | Hundley et al. | 220/254.5 |
| 2008/0000921 | A1 * | 1/2008 | Leon | 220/713 |
| 2008/0054005 | A1 * | 3/2008 | Cai | 220/711 |
| 2009/0050641 | A1 * | 2/2009 | Ivey | 220/713 |
| 2011/0284564 | A1 | 11/2011 | Hsieh et al. | |
| 2013/0020338 | A1 * | 1/2013 | French et al. | 220/713 |
| 2013/0037558 | A1 * | 2/2013 | Selina et al. | 220/715 |
| 2013/0277380 | A1 | 10/2013 | Koestring et al. | |

FOREIGN PATENT DOCUMENTS

WO 2013122371 A1 8/2013

* cited by examiner

*Primary Examiner* — Robert J Hicks
(74) *Attorney, Agent, or Firm* — Husch Blackwell LLP

(57) ABSTRACT

Beverage container lid with a container side and a consumer side, wherein the lid has a fastening portion running about a lid axis in a circumferential direction, which fastening portion defines a reference plane, wherein the lid has a drinking opening, wherein the lid has a lid face inclined with respect to the reference plane in such a way that, at least in a diametric strip, which contains the drinking opening, of the lid face, a nose tip receiving region of the lid face diametrically opposing the drinking opening is set back axially with respect to the drinking opening in the direction of the container side, the drinking opening and a tab being dimensioned and arranged in such a way that the nose tip region, even when the drinking opening is opened in accordance with intended use, remains uncovered by the tab on the consumer side.

18 Claims, 6 Drawing Sheets

BEVERAGE CONTAINER LID WITH AN INCLINED LID FACE

CROSS-REFERENCE TO RELATED APPLICATIONS

This Application claims priority to German Application Number 102013218866.8 filed Sep. 19, 2013, to Stephen Knipe entitled "Beverage Container Lid with an Inclined Lid Face," currently pending, the entire disclosure of which is incorporated herein by reference.

FIELD OF THE INVENTION

One embodiment of the present invention relates to a beverage container lid, which is configured for axial placing along a lid axis on a container edge, which surrounds a container opening, of a beverage container to cover the container opening, with a container side facing the container during intended use on the container and with an axially opposing consumer side generally facing a consumer, the lid having a fastening portion running about the lid axis in the circumferential direction, which fastening portion is configured to be positively and/or non-positively fixed to the container edge, and which defines a reference plane, the lid having a drinking opening passing through it axially, which, in the unused new state of the lid, is closed by a tab, which is movable relative to the remaining lid, the lid having radially within the fastening portion an edge, which projects with respect to the reference plane axially away from the latter toward to the consumer side, and is provided at least in that circumferential region of the lid, in which the drinking opening is also provided, the lid having radially within the projecting edge a lid face, which is set back axially toward the container side with respect to the projecting edge.

BACKGROUND OF THE INVENTION

A generic beverage container lid is, for example, known from U.S. Pat. No. 7,992,741. One drawback of the generic beverage container lid is its configuration in the region radially within the projecting edge, where the lid face is oriented substantially parallel to the reference plane and—like the projecting edge itself—is arranged offset, with respect to the reference plane, toward the consumer.

If a container covered with the generic lid is inclined when a consumer is drinking, a dome, which is elevated toward the consumer side and comprises the projecting edge and the lid face radially present within the dome, only allows a relatively small angle of incline in the known configuration before the lid collides with the nose of the consumer who is drinking.

In particular, in the case of containers that have already been relatively largely emptied, liquid can only be removed through the drinking opening of the generic lid when the consumer who is drinking, on the one hand inclines the container provided with the generic lid to a maximum extent and then additionally leans his/her head back in order to increase the absolute angle of incline of the container provided with the generic lid to such an extent that liquid quantities present in the container can be removed through the drinking opening.

This leads to an understandably uncomfortable drinking posture that is also experienced as unsafe owing to the head being leant back, which substantially reduces the acceptability of lids of this type among consumers. A person namely has the greatest handling safety when drinking from a vessel if the person influences the incline of the vessel exclusively with his wrist.

These problems also exist, for example, in the beverage container lid known from US 2008/0054005 A1, in which, however, no edge projecting toward the consumer side is provided in the open state of the drinking opening in that circumferential region, in which the drinking opening is also provided. Rather, the actual container edge is free in this known lid in the circumferential region of the drinking opening when the drinking opening is open.

Then, when the drinking opening of the beverage container lid known from US 2008/0054005 A1 is opened, the tab originally closing the drinking open is latched in the region of the lid diametrically opposing the drinking opening, to secure the open position. In this situation in accordance with intended use, the tab that is latched in the open position forms an elevation of the lid on the consumer side, which leads to an even earlier collision of the lid with the nose of the consumer who is drinking than if the tab were simply torn off the lid. Here, too, it is demanded of the consumer that he/she leans his/her head further and further back with increasing emptying of the container provided with the known lid, in order to be able to remove liquid from the container through the drinking opening.

The same also applies to a beverage container lid known from U.S. Pat. No. 5,490,609.

SUMMARY OF THE INVENTION

It is therefore the object of the present invention to develop the generic beverage container lid in such a way that during intended use, in other words, when a consumer is drinking from a container covered with the lid, it can be inclined to a greater extent than previously relative to the face of a consumer using the lid, so it is not necessary, or only substantially later, for the consumer to lean his/her head back when drinking from a container of this type.

This object is achieved according to one embodiment of the present invention by a drinking container lid of the type mentioned at the outset, in which the lid face is inclined with respect to the reference plane in such a way that at least in a diametric strip of the lid face containing the drinking opening, a nose tip receiving region of the lid face diametrically opposing the drinking opening is set back axially with respect to the drinking opening in the direction of the container side, the drinking opening and the tab being dimensioned and arranged in such a way that the nose tip receiving region, even when the drinking opening is opened in accordance with intended use, remains uncovered by the tab on the consumer side.

The solution according to the present invention ensures that a container covered with the beverage container lid according to the invention—compared to containers covered with lids of the prior art—can be inclined to a greater extent relative to the face of a consumer who is drinking, as the nose tip can enter the nose tip receiving region, which is set back with respect to the drinking opening in the direction of the container side, without the nose tip colliding with the lid, in particular with the lid face.

By configuring and arranging the tab closing the drinking opening in the original unused new state of the drinking container lid in such a way that the nose tip receiving region remains uncovered by the tab, even when the drinking opening is opened in accordance with intended use, the use of the nose tip receiving region can also be ensured during substantially the entire period of use of the lid according to the invention.

In this case, this can be achieved, when the tab is provided so as to be foldable, as is conventional, on the lid according to the invention and can be latched in an open position, freeing the drinking opening on the remaining lid, in that the tab is dimensioned in such a way that, even in the folded-over state, it does not cover the nose tip receiving region. As an alternative to this, a nose tip receiving region of the lid face that is substantially uncovered during the entire operating period can also be achieved by simply tearing the tab off the lid when the drinking opening is opened. The latter alternative is, however, may not preferred, as, after separation from the remaining lid, the tab has to be disposed of separately from the remaining lid as waste, while said lid is still being used as intended.

The term "diametric strip" means a strip passing through the lid face in the diameter direction and containing the lid centre. If the lid face does not have a circular shape, the diameter direction of the fastening portion should be used as the diameter direction of the diametric strip. This is generally circular as beverage containers generally have a circular container opening, also with a circular container edge.

The "diametric strip" in the sense of the present invention should be taken to mean a strip following the lid surface on the consumer side. It thus merely characterises a specific region of the lid without influencing its character or shape, with the exception that the drinking opening and the lid centre are to be contained in the diametric strip. Thus, the diametric strip is always at least so wide that the drinking opening is completely contained therein. In case of doubt, the diametric strip should not be wider than is necessary to receive the drinking opening therein.

The lid axis, when the beverage container is arranged in accordance with intended use on a container, will generally coincide with the longitudinal axis of the container. As the container edge, on which the beverage container lid according to the invention is to be arranged, is generally circular and level, the fastening portion on the lid can easily be recognised as such, even when the lid is not arranged on a container. In case of doubt, the lid axis should contain the centre point of the circular fastening portion and be oriented orthogonally with respect to the extension plane in which the fastening portion extends. The fastening portion generally has an axial extension in relation to the lid axis, which axial extension is slightly larger than a conventional mouth edge on a container, for example a drinking container. A conventional fastening portion may have an axial extension of no more than 5 to 10 millimeters. Basically, any virtual plane that is conceivable in the region of the fastening portion can be used as the reference plane. Alternatively, the beverage container lid according to the invention can be intended to be attached in accordance with intended use to a container, to determine the reference plane, the extension plane of the container opening, which is orthogonal to the container axis, then being used as the reference plane of the beverage container lid. If the fastening portion has projections projecting radially toward the lid axis and inwardly in order to latch the beverage container lid according to the invention, so as to engage it behind a mouth edge bead of a container, a virtual plane running through the sites of the radial latching projections located radially furthest in can be used as the reference plane.

Likewise, it may be provided that the fastening portion is configured to surround the container edge on two sides, radially outwardly and axially, the portion of the fastening portion axially opposing the container edge then preferably defines the reference plane when the lid is placed on a container.

All the possible reference planes mentioned are parallel to one another and are located axially only a few millimeters apart.

Even if the drinking opening can be formed completely or partially in the projecting edge, which then has to have an adequate radial extension at the location of the drinking opening, it is preferred, both from a manufacturing point of view and from ergonomic points of view if the drinking opening is partially, or particularly preferably, completely, configured in the inclined lid face. The lid face, which generally takes up more than half, particularly preferably more than 70%, of the face situated radially within the projecting edge, provides an adequately large face to provide the drinking opening therein.

According to a further point of view of the present invention, a flat face parallel to the reference plane may be configured radially within the projecting edge, the inclined lid face adjoining said flat face. For example, the inclined lid face, along a substantially straight bend axis, can adjoin the flat face and enclose an angle therewith. It is preferred in terms of manufacturing and ergonomically if a hinge axis of the tab closing the drinking opening in the unused new state coincides with the bend axis. However, this does not have to be the case. Moreover, no mathematically precise coincidence is intended by "to coincide", but a conventional deviation from an exact positional identity within the usual manufacturing tolerances when producing beverage container lids. Thus, the hinge axis of the tab in the sense of the present invention should still be regarded as coinciding with the aforementioned bend axis when the hinge axis and bend axis have a spacing that is no larger than 1 mm.

The drinking opening may be configured in said flat face, so the drinking opening face is substantially level. The drinking opening preferably does not then extend beyond the bend axis, as the region of the bend axis can be used to configure the hinge axis.

Likewise, the drinking opening configured in the flat face preferably does not extend into the projecting edge, which preferably projects axially in relation to the flat face toward the consumer, to facilitate the drinking opening being surrounded by the lips of the consumer. As a result, an undesired, unintentional spilling of liquid is prevented when a consumer is drinking out of the drinking opening.

The inclined lid face can be formed from a plurality of part lid faces with a different incline with respect to the reference plane, the incline of the individual part lid faces preferably increasing with an increasing spacing from the drinking opening in order to form an adequate indentation at the expected meeting point of the nose tip.

Two directly adjacent part lid faces can then adjoin one another along an angling axis, the one or more angling axes preferably being parallel to one another between two part lid faces. The angling axis/axes is/are preferably parallel to the aforementioned bend axis at the edge of the flat face if such a one is provided.

Basically, it can also be intended to configure the lid face with a curvature, for example about an axis of curvature that is parallel to the reference plane and orthogonal to the running direction of the aforementioned diametric strip in order to thereby provide the incline mentioned at the outset. The lid face is, however, preferably level for reasons of simple manufacturing. The level configuration of the lid face does not exclude the lid face itself having depressions or elevations in a manner known per se, with which warning or content indications relating to a later container content are linked. However, configuring simple lid faces without elevations and depressions has also been intended.

In order to provide as large a space as possible for the nose tip to approach the beverage container lid according to the invention when drinking from a container covered with the lid, it may be provided that the lid face in the region of the nose tip receiving region is situated on a different side of the reference plane to the drinking opening. In particular, in the afore-designated preferred case of a definition of the reference plane by a portion of the fastening portion axially opposing the container edge when placed on the container, it can thus be ensured that the nose tip receiving region, when the lid is placed on, projects at least in regions into the container volume. Therefore, a part of the container volume is even reserved as an entry space for the nose tip, which allows a sharp incline of the container covered with the beverage container lid according to the invention relative to the consumer's face.

Adequate space for receiving the nose tip in the region radially within the projecting edge on the one hand and, at the same time, as small as possible an entry of the nose tip receiving region of the lid face into the container volume can be achieved in that the lid face is inclined by more than 8°, but less than 20° with respect to the reference plane in one embodiment. As such, when the beverage container lid is arranged on a rotationally symmetrical container, the reference plane is oriented parallel to a standing face of the container on a level base, inclines of more than 20° with respect to the reference plane can lead to an increasingly restricted legibility of indications possibly provided on the lid face. Moreover, the nose receiving region of the lid face could then take up too great a proportion of the container volume. In the case of a curved lid face or an inclined lid face formed from a plurality of part lid faces, the incline of a part lid face or a portion of the curved lid face, in particular in a region a long way away from the drinking opening, may exceed the given upper limit and/or, for example in a region close to the drinking opening, be smaller than the lower limit. The average incline over the entire curved lid face or over all the part lid face should then be within the given limits.

An average incline of less than 8° can lead to an undesirably early collision of the nose tip with the lid face and therefore to the problems mentioned at the outset.

The nose tip receiving space becomes larger when the average incline of the lid face is more than 10° and even larger, if this is more than 12°, with respect to the reference plane.

Likewise, possible indications on the lid face can be read more easily when the average incline is smaller, for example if it is less than 18° and, in particular, less than 16°.

In order to avoid the tab being torn off the lid to free the drinking opening and then being undesirably disposed of into the environment as small waste, it is provided according to a preferred development of the present invention that the tab can be folded about a hinge axis between a closing position, in which it closes the drinking opening, and an open position in which it frees the drinking opening for axial through-flow, the tab preferably being fixable in its open position on the lid face. What was stated above then applies, in that the tab does not cover the nose tip receiving region of the lid face even when it is fixed in its open position on the lid face.

It should be explained again with regard to this that the term "nose tip receiving region" designates at least one region of the lid face that is so large in dimension that a human nose tip can approach the lid face until it rests thereon. It should be assumed that the nose tip receiving region on the lid face has at least a face with edging that is circular in plan view and with an area content of at least a one square centimeter. The nose tip receiving region may be configured as an indentation configured locally in the inclined lid face relative thereto to receive particularly long noses. The indentation is located within the aforementioned diametric strip and can project laterally beyond the latter.

As the nose tip is situated precisely over the mouth—due to anatomy—when a consumer is drinking from a container covered with the lid according to the invention, the nose tip receiving region is provided in the diametric strip containing the drinking opening on the lid face.

In a manner known per se, it may be provided that the hinge axis runs orthogonally to a section line of a section plane, which passes centrally through the drinking opening in the circumferential direction and contains the lid axis, with the lid face. In this case, the tab, when fastened on the lid face, is arranged between the nose and mouth when a consumer is drinking, so it frees the nose tip receiving region.

The nose tip receiving region can be prevented from being covered by the tab fixed to the lid face in its open position, when the total of the maximum distance of an edge of the drinking opening from the hinge axis and of the maximum distance of an edge of the tab from the hinge axis be more than two fifths, but less than two thirds of the dimension of the lid face along the section line mentioned above, the hinge axis being provided in such a way that it crosses the section line in a region of a fifth to a third of the length of the section line.

Basically, it is advantageous for enjoyment when drinking a liquid from a container covered with the lid according to the invention if the drinking opening has as large a face as possible. Drinking openings of the prior art, have, for this purpose, as large a radial extent as possible. This can ensure that aromas in the gas phase before and even during drinking from the drinking opening reach the nose of the consumer, so the consumer cannot only taste the liquid present in the container but can also smell it. This intensifies the taste impression considerably when a consumer is drinking.

A large radial dimension of the drinking opening known from the prior art would, in the afore-designated arrangement of the hinge axis lead to the flap, in the open position, covering the nose tip receiving region, at least partially. It is therefore preferably provided that the drinking opening may have a larger dimension in the circumferential direction than in the radial direction, preferably a dimension that is larger by more than 1.5 times. Therefore, a drinking opening with a large opening face can nevertheless also be provided for an olfactory perception of the liquid located in the container without a tab folded over into the open position leading to a collision with the nose tip when a consumer is drinking.

The nose receiving region of the lid face can advantageously, before drinking—for example during transportation of a container filled with liquid and covered with the lid according to the invention from a collection site to a consumption site—be used as a carrying, or storage aid for relatively small articles, such as small change, sugar sachets or milk or lemon juice packs for example. It may be provided for this purpose that the projecting edge is also configured in a region diametrically opposing the drinking opening and preferably runs completely about the lid axis, an inner wall running from the apex of the projecting edge to the lid face enclosing, with the lid face, an angle of no less than 90°, preferably no less than 95° and an angle of no more than 110°, preferably no more than 100° at the circumferential site of the largest axial spacing of the lid face from the drinking opening. In this case, the small items mentioned by way of example above may be arranged in the concave volume formed between the lid face and inner wall. To prevent the items stored on the lid face in the nose tip receiving region from falling down unintended, including falling down laterally, the projecting edge is preferably configured to run completely about the lid axis. In the latter case, the projecting edge preferably extends axially beyond the lid face along the entire lid circumference.

To facilitate drinking from a container covered with a lid according to the invention, it is advantageous if the drinking opening has as large a spacing as possible, away from the reference plane toward the consumer, from the reference plane, while it is advantageous for the nose tip receiving region, for the aforementioned reasons, if the latter has as small a spacing as possible, or even a negative one, from the reference plane in the direction of the consumer.

Surveys of consumers have shown that too large an axial spacing of the drinking opening from the reference plane in the direction of the consumer leads to associations with feeding cups for consumers, with which the target group of "beverage to go" products, for whom the lid according to the invention is mainly intended, does not identify. The undesired feeding cup impression can be avoided with, at the same time, good ergonomics of the drinking opening and of the nose tip receiving region by the above-described incline of the lid face, in particular in that the projecting edge is also configured in a circumferential region diametrically opposing the drinking opening and preferably runs completely about the lid axis, the spacing of the projecting edge from the reference plane toward the consumer being greater in the circumferential region of the drinking opening than in the circumferential region diametrically opposing the drinking opening, the spacing of the projecting edge from the reference plane toward the consumer can be in particular maximal in the circumferential region of the drinking opening and being minimal in the circumferential region diametrically opposing the drinking opening.

The inclined lid face described at the outset actually permits a high degree of design freedom when arranging the drinking opening on a beverage container lid, in particular in the axial arrangement. Since the drinking opening in said diametric strip is diametrically opposed to the nose tip receiving region that is set back with respect to the drinking opening, it is always elevated in the axial direction relative to the nose tip receiving region, in other words closer to the consumer. As a result, an elevated arrangement of the drinking opening, for example on a base and the like, can be dispensed with. However, until now drinking container lids were almost exclusively used, in which the drinking opening—when the drinking container lid is viewed when attached to a container—is offset with respect to the container opening toward the consumer. As a result, a certain familiarization with this lid form has occurred amongst customers. The design freedom achieved by the present lid construction now allows this consumer expectation to be made use of without awakening the feeding cup association.

Therefore, the projecting edge in the region of the drinking opening relative to the reference plane may be axially higher than in the remaining circumferential region of the lid, but not so much higher than the region diametrically opposing the drinking opening that the lid according to the invention would awaken associations with pediatric or geriatric drinking vessels. Thus, the consumer can intuitively recognise without problems even at a fleeting glance, where to place his/her lips on the lid when wanting to drink. However, the drinking opening can also—when the drinking container lid is viewed when arranged in accordance with use on a drinking container—be situated in a volume region enclosed by the container wall including any mouth edge.

A particularly advantageous ergonomic drinking experience can be achieved by the drinking opening being arranged axially at a spacing from the portion of the projecting edge located closest to it, and specifically being arranged offset away from the projecting edge toward the container side, in other words toward the reference plane. This spacing should, however, not be too large, so that liquid leaving the drinking opening reaches the lips of the consumer resting on the portion of the projecting edge closest to the drinking opening as soon as possible after leaving the drinking opening. Thus an undesired spilling of liquid can be avoided during drinking.

Good drinking ergonomics with, at the same time, an advantageously large angle of incline of the lid relative to the face of the drinking consumer can thus be achieved in that the projecting edge is also configured in a circumferential region diametrically opposing the drinking opening and preferably runs completely about the lid axis, the spacing of the projecting edge from the lid face in the circumferential region of the drinking opening being smaller than in the circumferential region diametrically opposing the drinking opening, the spacing of the projecting edge from the lid face in the circumferential region of the drinking opening, in particular, being minimal and being maximal in the circumferential region diametrically opposing the drinking opening.

It is particularly advantageous here that owing to the axial offset of the drinking opening from the projecting edge in the direction away from the consumer, at least in the circumferential region of the projecting edge, in which the drinking opening is arranged, the projecting edge, with respect to its shape, can be configured like the mouth edge of the container, on which the lid according to the invention is placed. Thus the lips of the consumer when drinking touch the projecting edge and not the possibly sharp-rimmed edge of the drinking opening. When resting his/her lips on the projecting edge the consumer, when drinking, then has the identical feeling to when resting his/her lips on the container uncovered by a lid. It may, in particular, be provided for this that the projecting edge in the circumferential region of the drinking opening, in a direction that is orthogonal to the circumferential direction, has a radius of curvature of no less than 0.5 mm, preferably no less than 1.2 mm and of no more than 2 mm, preferably no more than 1.8 mm, particularly preferably a radius of curvature of a container edge surrounding a container opening, in particular a container mouth edge.

It should also be added that "toward the consumer" or "toward the consumer side" in the sense of the present application designates a direction pointing away from the lid along the lid axis on the consumer side of the lid. Likewise, "toward the container" or "toward the container side" designates a direction pointing away from the lid along the lid axis on the container side.

The beverage container is preferably a beverage container, as is used in street vending of hot drinks.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Figure 1:
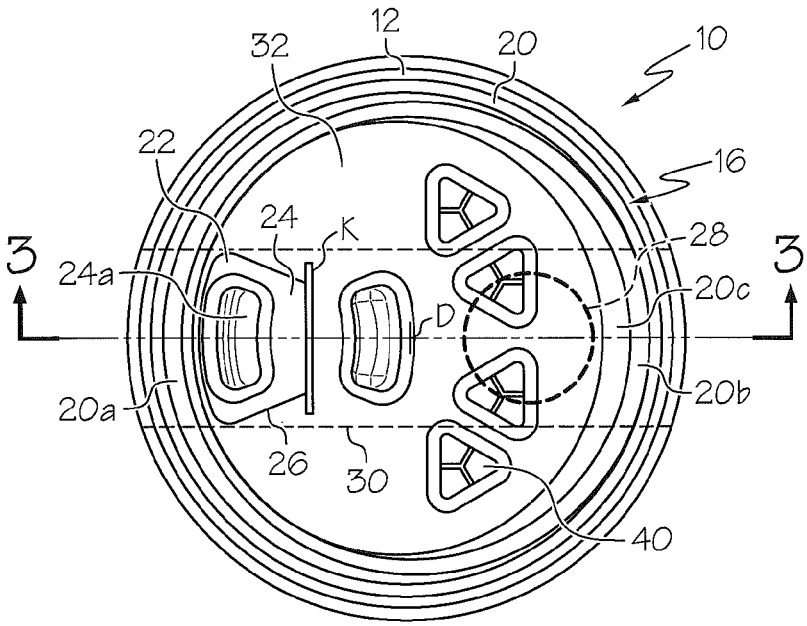
FIG. 1 is a top plan view (view of the consumer side) of a first embodiment according to the invention of a beverage container lid of the present application.
Figure 2:
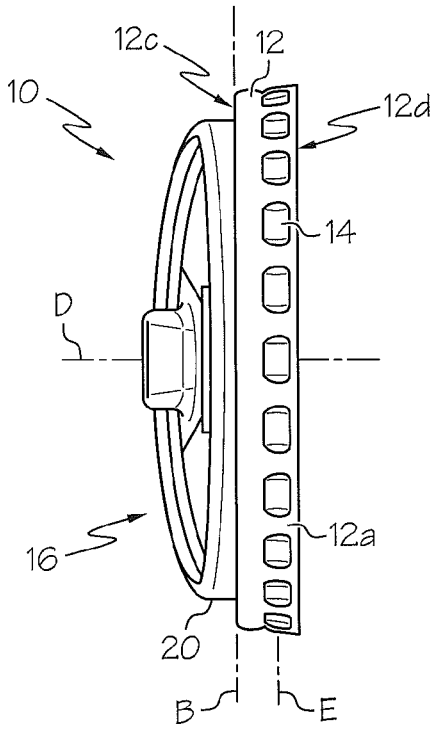
FIG. 2 is a back side view of the lid of FIG. 1.

Equal components are always provided with equal reference numerals in the figures.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

A first embodiment of a beverage container according the invention is designated in general by 10 in FIGS. 1 to 6. The beverage container lid 10 designated merely a "lid" below has a fastening portion 12, which is configured to be fixed to a container edge of a beverage container. The fastening portion 12, as shown in the present embodiment, is preferably configured to be latched in a manner that can be overcome to a generally bead-like mouth edge of a beverage container. For this purpose, the lid 10 may have undercut formations 14, which can be provided on a collar portion 12*a* of the fastening portion 12. The undercut formations 14 can preferably be arranged in an arrangement plane E so as to project radially and inwardly toward a virtual lid axis D and to run about the lid axis D, preferably to run equidistantly in the circumferential direction.

If, as in the present example of the embodiment shown, the fastening portion 12 has a circular shape in plan view—in other words if the lid 10 is configured to be placed on a container with a circular container edge—the lid axis D should go through the centre point of the circle of the fastening portion 12.

In the present embodiment, the fastening portion 12 can have a first, radial circumferential face 12*b*, which surrounds the container edge of the container radially and outwardly when the lid 10 is placed on a container, not shown. Furthermore, the fastening portion 12 may have a second, axial circumferential face 12*c*, which, when placed on the container, axially opposes the container edge, in relation to the lid axis D. The axial circumferential face 12*c* of the fastening portion 12 is intended to define, in the present embodiment, a reference plane B, which is used for closer description of the lid 10. The reference plane B, in the present case, is orthogonal to the lid axis D and parallel to the standing face of a rotationally symmetrical container, which carries the lid 10 in accordance with intended use and stands on a level base. The reference plane B in the example shown is parallel to the aforementioned extension plane E and moreover parallel to the course of an edge 12*d* of the fastening portion located axially away from the axial circumferential face 12*c*. The property last mentioned and the parallelity of the reference plane to the extension plane E are merely advantageous, but do not absolutely have to be present.

As a further term definition the side of the lid 10 facing the consumer when placed on a container during intended use is designated the consumer side 16. This is the side of the lid 10 facing the observer of FIG. 1.

Accordingly, the opposing side facing the container when placed on the container during intended use, is designated the container side 18. This is the side of the lid facing the observer in FIG. 6.

Figure 4:
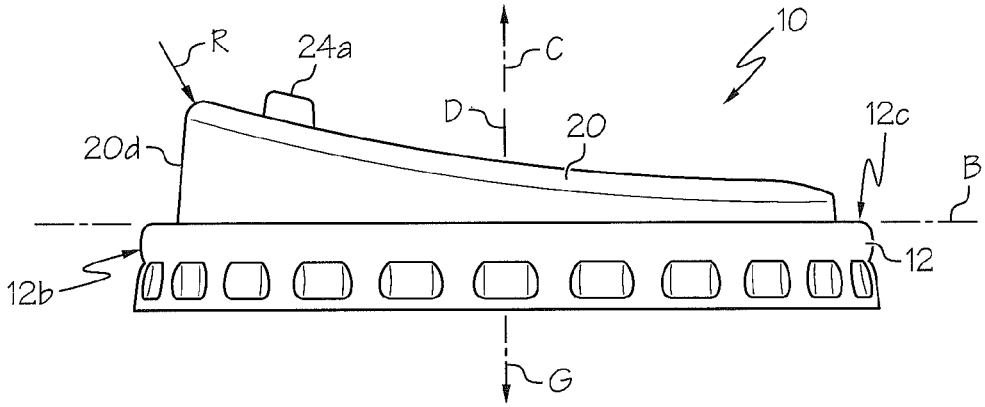
FIG. 4 is a side view of the lid of FIG. 1.
Figure 5:
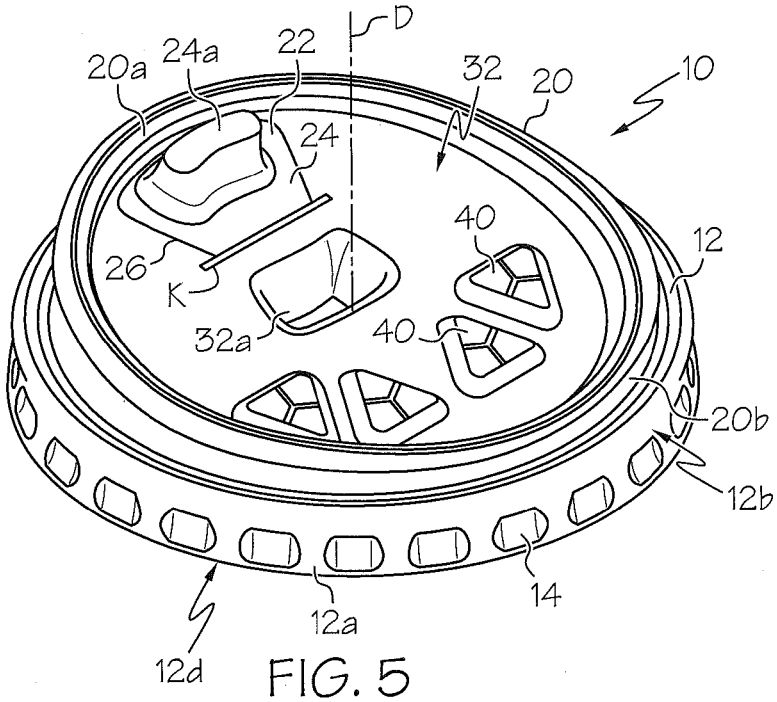
FIG. 5 is a top perspective view of the lid of FIG. 1.
Figure 6:
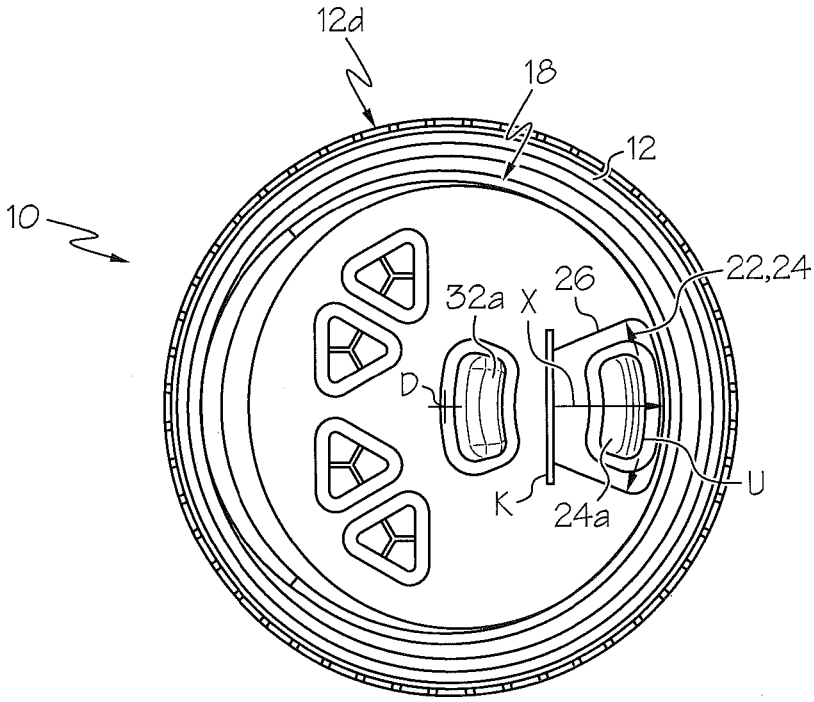
FIG. 6 is a bottom view (view of the container side) of the lid of FIG. 1.

The arrow C in FIG. 4 shows the direction from the reference plane B toward the consumer or toward the consumer side 16. The arrow G in FIG. 4 shows the direction from the reference plane B toward the container or toward the container side 18.

An axially projecting edge 20, which extends away from the reference plane B toward the consumer 16 and which, in the embodiment shown, runs in a completely closed manner about the lid axis D is located radially within the fastening portion 12, in relation to the lid axis D. An indentation lowered toward the container side 18 may be provided radially between the projecting edge 20 and the fastening portion 12 in order to collect any liquid running off the edge after use and to provide a certain resilient relative mobility of the projecting edge relative to the fastening portion, so the projecting edge 20 can, when abruptly placed against the lips of the consumer, yield to the material resilience in accordance with the configuration of the channel formed.

Furthermore, the embodiment shown in FIGS. 1 to 6 has a drinking opening 22, which may optionally be closed by a tab 24 when the lid 10 is in the unused original state shown in the figures. In a manner known per se, the tab 24, in the original state shown, is preferably connected in a material uniting manner to the remaining lid by means of a predetermined breaking point 26, the course of which coincides with the later edge of the drinking opening 22.

In the embodiment of FIGS. 1 to 6, the drinking opening 22 is configured in such a way that its maximum dimension U in the circumferential direction may be greater than its maximum dimension X in the radial direction (see FIG. 6), so the opening face of the drinking opening 22 can be made sufficiently large to allow aromas of the container content to escape through it in the gas phase toward the consumer, without the drinking opening 22 or the tab 24 originally closing it when the lid 10 is open, disturbing a nose tip receiving region 28 of the lid 10. This nose tip receiving region 28 is located at a site, in which a nose tip of the consumer is located due to anatomy, when the drinking opening 22, in accordance with intended use, is placed against the lips to drink liquid from a container covered with the lid 10 and the lid together with the container is inclined. The nose tip receiving region 28 is therefore located in a diametric strip 30, which contains the drinking opening 22 and extends in the diameter direction across the lid 10. In order to prevent any pathological interpretation, it is made clear, that, in case of doubt, the width of the diametric strip 30 should be determined orthogonally to its diameter/extension direction by the extent of the drinking opening 22 in the same direction.

A lid face 23, which is provided within the projecting edge 20 and is preferably level, is inclined with respect to the reference plane B in such a way that the nose tip receiving region 28 is set back axially toward the container side 18 with respect to the drinking opening 22. As a result, it is made possible for a consumer drinking from the drinking opening 22 to incline a container covered with the lid 10 more than is possible in the prior art about an axis of incline that is orthogonal to the lid axis D and to the diameter/extension direction of the diametric strip 30 in order to be able to incline this container as completely as possible without the lid 10 colliding with the nose tip of the consumer, without the consumer having to bend his/her body beyond the incline of the container or lid to assist the emptying of the container, or having to bend in some other way. As a result, for example, it becomes possible to use containers with steeper or even cylindrical side walls as the incline of the container wall, because of the nose tip receiving region 28 that is set back axially with respect to the drinking opening 22, does not need to assist the emptying of the container provided with the lid 10. With the lid 10 according to the invention, an undesired collision with the nose tip only occurs at larger relative angles of incline of the lid 10 relative to the face of the person drinking from it.

As known in general from the prior art, the tab 24 can be folded about a hinge axis K between its closing position shown in the figures and an open position, in which a projection 24*a* of the tab 24 is fixed in a fixing recess 32*a* of the lid face 32. The hinge axis K may lie in the extension plane of the lid face 32.

Because of the previously outlined advantageous dimension of the drinking opening 22 and, connected therewith, of the tab 24, namely with a larger dimension in the circumferential direction about the lid axis D than in the radial direction, it can be ensured that even when the tab 24 is in its open position described above, it does not cover the nose tip receiving region 28 of the lid 10. The latter thus remains free and accessible as a receiving space for the nose tip.

Figure 3:
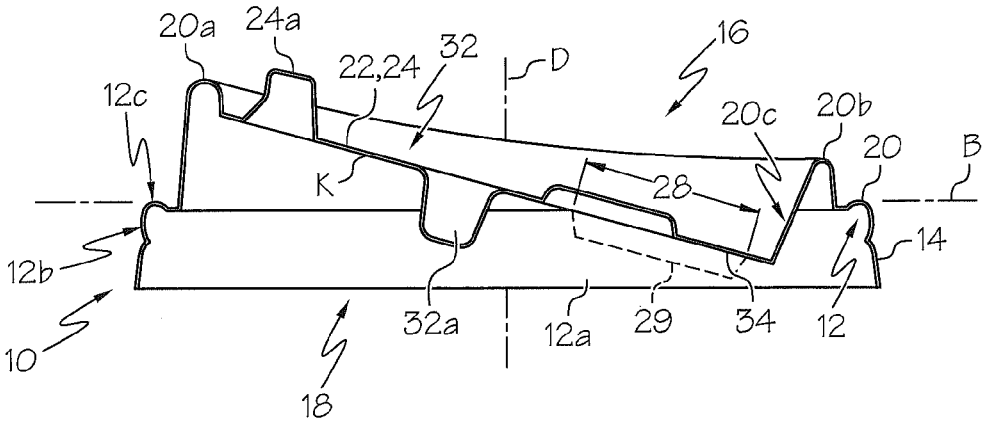
FIG. 3 is a sectional view of the lid of FIG. 1 taken generally along the section plane 3-3.

The section line 34 of the lid face 32 is shown in FIG. 3 with a longitudinal centre plane, which is orthogonal to the reference plane B and passes through the drinking opening 22 in its circumferential centre.

In order to arrange the drinking opening 22 adequately close to the circumferential portion 20*a*, which directly surrounds the drinking opening 22, of the projecting edge 20, it is provided that the hinge axis K crosses the section line 34 in a region of a fifth to a third of the length of the section line 34. In the embodiment shown, the hinge axis K intersects said section line 34 in a region of about a quarter to a third of its length, more precisely at about 28% of its length measured from the end closer to the drinking opening to the end of the section line 34 closer to the nose tip receiving region.

In order to be able to ensure the freedom of the nose tip receiving region 28 even when the tab 24 is completely folded over and latched to the recess 32*a*, the total of the maximum radial spacing X of the edge 26 of the drinking opening 22 from the hinge axis K (also X) and the maximum radial spacing of the edge of the tab 24 from the hinge axis K is no more than two thirds of the dimension of the lid face along said section line 34. In order to nevertheless be able to ensure adequate liquid removal through the drinking opening 22, the total of said spacings should not fall below two fifths of the length of the section line however.

In the present example, the total of said radial spacings is slightly more than half the length of the section line, namely between 52 and 53%. The space within the projecting edge 20 reserved anatomically for the nose tip of the consumer when drinking thus reliably remains free when the aforementioned preferred crossing point of the hinge axis K with the section line is realised.

In order to provide adequate space to receive the nose tip of the consumer when drinking, it may be provided that the lid face 32 in its end region located away from the drinking opening 22, in other words in the end region having the nose tip receiving region 28, is arranged on the other side of the reference plane B than the drinking opening 22. At least a part of the nose tip receiving region 28, when viewed in a used state and placed on a container, is then located in the region of the volume enclosed by the container, so a part of the container volume is also used as a receiving space for the nose tip of the consumer when drinking.

The circumferential portion 20*b* of the projecting edge surrounding the nose tip receiving region 28 directly in the circumferential direction diametrically opposes the circumferential portion 20*a* of the same edge 20 assigned to the drinking opening 22. An inner wall portion 20*c* sloping away from the portion 20*b* of the projecting edge 20, which is situated in the circumferential region of the nose tip receiving region 28, towards the lid face 32, preferably encloses an angle of 90° to 110° with the lid face 32 in the sectional view of FIG. 3, in other words in the centre plane of the lid 10 that is orthogonal with respect to the lid axis D and to the diameter/extension direction of the diametric strip 30. As a result, a volume limited in this circumferential region 20*b* by the projecting edge 20 and by the lid face 32 can also be used as a temporary receiving space to deposit items, for example during the transportation of a container covered by the lid 10.

To be exact, the consumer, who has just bought a fresh cup of coffee and would like to consume a pastry also purchased with this, possibly does not have a hand free when leaving the site of purchase. The consumer can then deposit sugar sachets, small change, packaged coffee cream and the like in the described receiving space until reaching the site at which he/she would like to consume the purchased drink and the pastry and can very probably deposit the cup and the pastry.

Because of the incline described above of the lid face 32 at least in the diametric strip 30, this receiving space can be formed with an adequate volume, although the edge 20 preferably projects less from the reference plane B in the direction toward the consumer in the circumferential portion 20*b* of the nose tip receiving region 28 than in the circumferential portion 20*a* of the drinking opening 22. Thus, a lid that appears discrete is provided, having improved functionality compared to the prior art.

The drinking opening 22, which is preferably arranged completely in the level lid face 32 for reasons of simple manufacturing, is moved radially close to the circumferential portion 20*a* of the projecting edge 20 in order to facilitate the removal of liquid from it without the risk of undesired spilling of liquid and therefore of soiling the clothes of the consumer. The drinking opening 22 is preferably axially offset away from the consumer with respect to the circumferential portion 20*a* of the projecting edge 20, so the lips of the consumer when drinking do not, or only to a small extent, touch a possibly sharp-rimmed edge of the drinking opening.

The acceptability of the lid 10 amongst consumers can also be increased in that the circumferential portion 20*a* of the projecting edge in the region of the drinking opening 22 is configured with a radius R of curvature (see FIG. 4), which corresponds to radii of curvature of conventional bead-like mouth edges of containers, which are radii of curvature of more than 0.6 mm, preferably more than 0.8 mm, or even more than 1 mm, but less than 2 mm, preferably less than 1.8 mm or even less than 1.6 mm. Thus, the consumer when drinking out of the lid 10 according to the invention can be given the feeling of drinking from a conventional container. Therefore, the consumer is relieved of any disconcerting feeling which could otherwise set in when drinking from a drinking container lid. The radius R of curvature is situated here in a plane containing the lid axis D.

The projecting edge 20 generally has its largest axial distance from the reference plane B in the circumferential portion 20*a* of the projecting edge, in which the drinking opening 22 is situated, so a contact region for the lower lip of the consumer can be created on the outer wall 20*d*, which, on the consumer side 16, falls away from the edge portion 20*a* toward the fastening portion 12. This is ergonomically advantageous, wherein the configuration of the lid 10 helps to limit the total elevation difference between the drinking opening-side circumferential portion 20*a* and the opposing circumferential portion 20*b* by the inclined lid face, at least in the diametric strip 30, so the impression frequently produced by drinking-container lids of a feeder cup or the like, which prevents consumers from using such a beverage container lid similar to pediatric or geriatric vessels, does not occur.

The beverage container lid 10 presented here is therefore ergonomically advantageous without the ergonomic advantages achieved requiring a configuration that would impair acceptability for consumers in the market.

Undercut formations 14 are not shown in FIG. 3 for the sake of clarity.

The nose tip receiving region 28, as shown by dashed lines in FIG. 3 and designated 29, can be formed by a local indentation with a still greater receiving volume.

Figure 7:
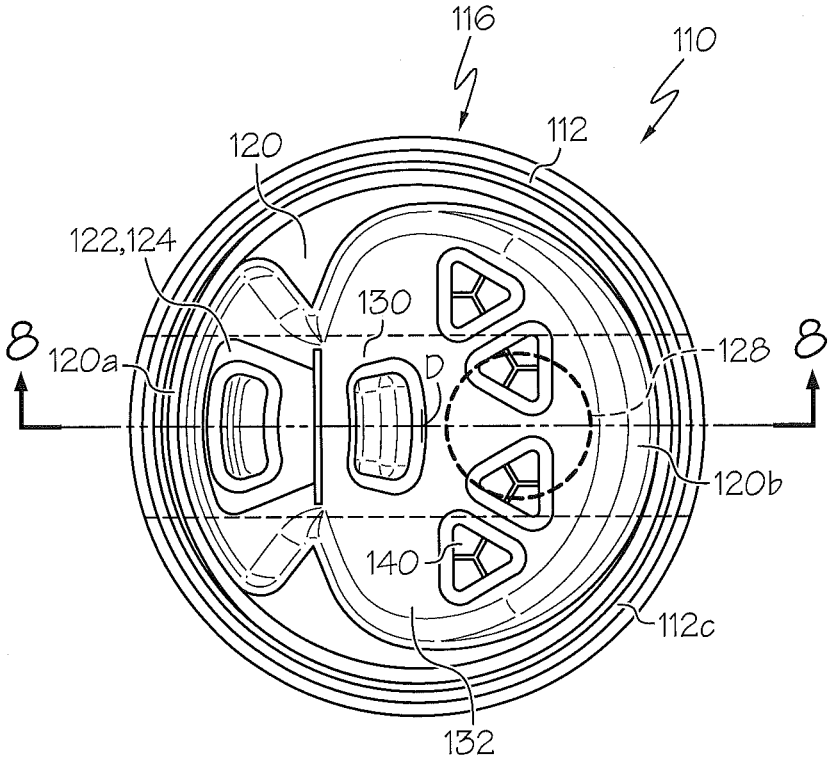
FIG. 7 is a top plan view (view of the consumer side) of a second embodiment according to the invention of a beverage container lid of the present application.
Figure 8:
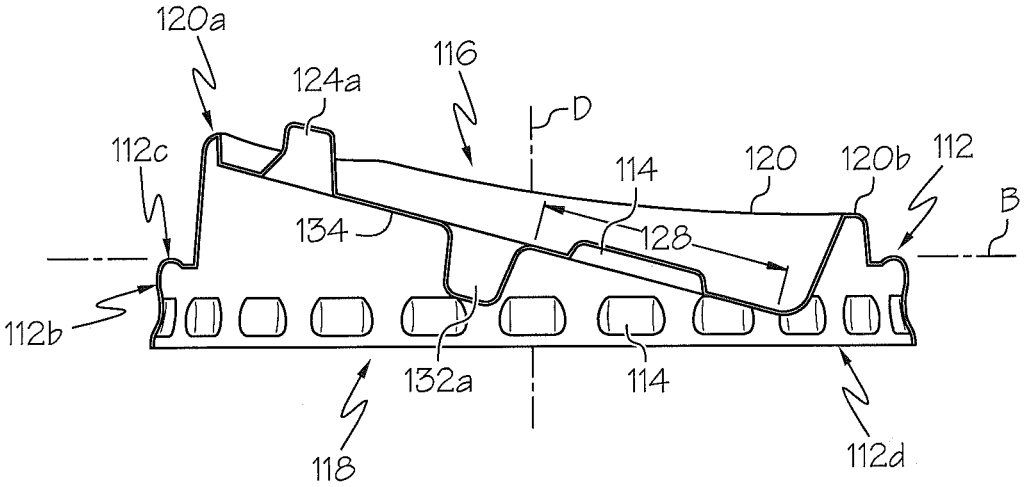
FIG. 8 is a sectional view of the second embodiment of the lid of FIG. 7 taken generally along the section plane 8-8.

An alternative second embodiment of a beverage container lid according to the invention is shown in FIGS. 7 and 8.

The same and functionally equivalent components or component portions as in FIGS. 1 to 6 of the first embodiment are provided with the same reference numerals in FIGS. 7 and 8 of the second embodiment, but increased by the number 100. The second embodiment will only be described below to the extent that it differs from the first embodiment, to the description of which reference is otherwise expressly made.

The substantial single difference between the first and the second embodiments is the configuration of the projecting edge 20 or 120, which is configured widened radially and inwardly in the region of the hinge axis K in the second embodiment of FIGS. 7 and 8. This can facilitate the guidance of the lid when resting the region containing the drinking opening 122 against the upper lip of the consumer.

It should be noted with respect to the two embodiments that conventional marking information may be configured on the lid face 32, said marking information being to facilitate the later use of the lid 10 or 110. For example, markings can be provided conventionally as predetermined breaking point projections 40 or 140, to identify the container contents. The provision of predetermined breaking point projections 40 of this type, likewise the provision of a latching indentation 32*a* or 132*a*, should basically not change anything about the evaluation of the lid face 32 as level, as long as the remaining lid face 32 free of functional formations is level.

A third embodiment of the present invention is shown in FIGS. 9 to 12. The third embodiment will only be described below to the extent that it differs from the previous two embodiments, to the description of which reference is otherwise expressly made.

The same or functionally equivalent components or component portions as in the first embodiment are provided with the same reference numerals, but increased by the number 200.

The third embodiment has, radially within the axially projecting edge 20, a flat face 231, which is parallel to the reference plane B and in which the drinking opening 222 is configured once the tab 224, starting from the unused new state shown in FIGS. 9 to 12 has been folded about the hinge axis K.

The inclined lid face in the third embodiment shown in 9 to 12 is formed from two part lid faces 232*b* and 232*c*. The part lid face 232*b* adjoins the flat face 231 having the drinking opening along a bend axis KA. The bend axis KA preferably coincides with the hinge axis K of the movable tab 224.

The first part lid face 232*b* encloses a first angle with the flat face 231.

The second part lid face 232*c* adjoins the first part lid face 232*b* along an angling axis AA which is preferably parallel to the bend axis KA. The second part lid face 232*c* encloses an angle with the first part lid face 232*b* and encloses a second angle with the flat face 231. In this case, the first angle is preferably larger than the second angle. As the first and the second angle in the embodiment shown are in each case obtuse angles, in other words angles greater than 90°, this means that the first part lid face 232*b*, with respect to the reference plane B, is less strongly inclined than the second part lid face 232*c*. The flat face 231, as already stated above, is parallel to the reference plane B.

Unlike the third embodiment shown in FIGS. 9 to 12, the second lid face 231*b*, as the only inclined lid face 232, can directly adjoin the level face 231. As an alternative to this, more than the two part lid faces 232*b*, 232*c* shown may be provided, the further part lid faces preferably following one another in a direction orthogonal to the bend axis KA away from the drinking opening 222. The possible further part lid faces may adjoin one another in each case along an angling axis, the individual angling axes preferably in each case being able to be parallel to the bend axis KA.

To facilitate a resetting of the tab 224 from a state in which it is locked in the indentation 232*a*, the indentation 232*a* can be configured with an engagement hollow 232*a*1 which is preferably provided on the side of the indentation 232*a* away from the hinge axis K.

It is likewise conceivable that level part lid faces in an inclined lid face, which are inclined with respect to the reference plane and represented by the part lid faces 232*b* and 232*c*, alternate with curved inclined part lid faces, or that a level and a curved part lid face are provided.

Figure 9:
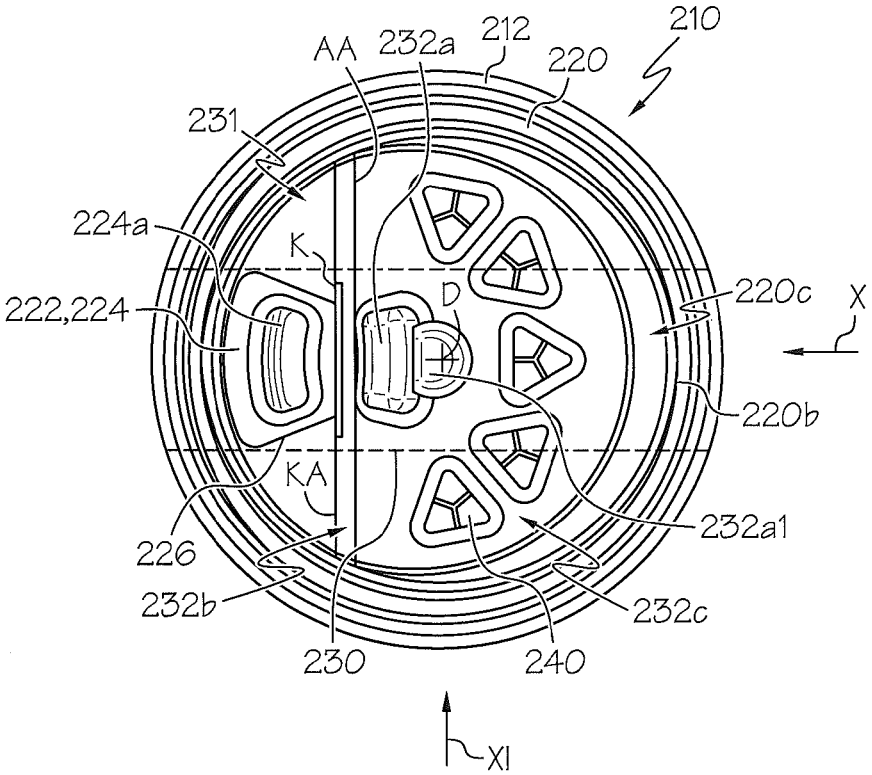
FIG. 9 is a top plan view (view of the consumer side) of a third embodiment according to the invention of a beverage container lid of the present application.
Figure 10:
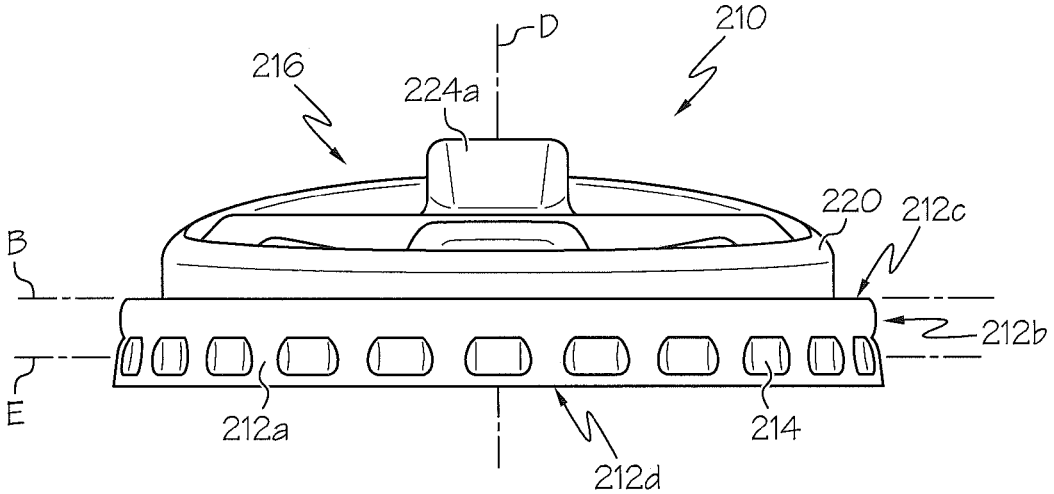
FIG. 10 is a back side view of the lid of FIG. 9.
Figure 11:
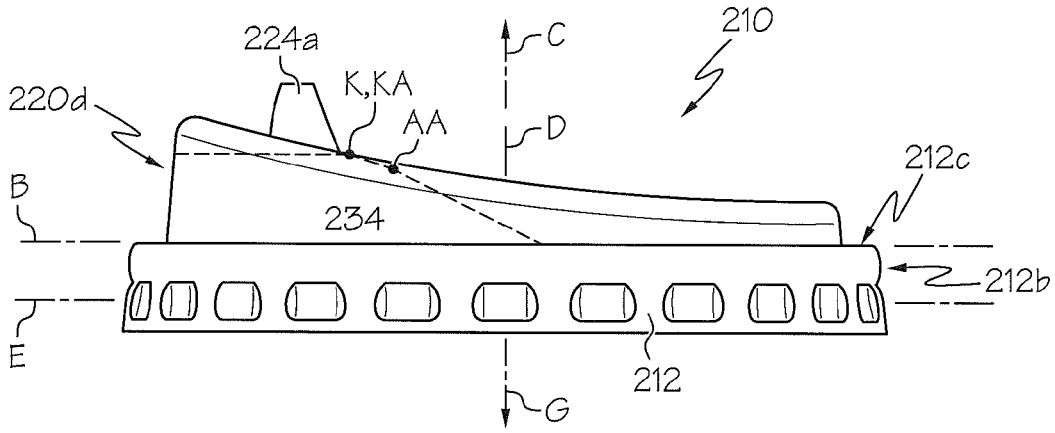
FIG. 11 is a side view of the lid of FIG. 9.
Figure 12:
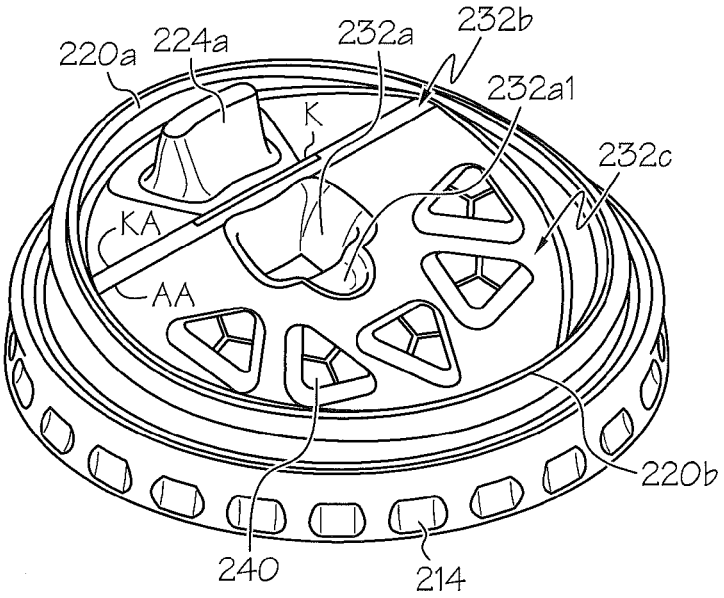
FIG. 12 is a top perspective view of the lid of FIG. 9.

In the case of a curved lid face or a curved part lid face, the axis of curvature is preferably parallel to the bent axis KA shown in FIG. 9 or to the hinge axis K.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A beverage container lid configured for axial placement along a lid axis on a container edge surrounding a container opening of a beverage container to cover the container opening, the beverage container lid comprising:

a container side facing the container during use on the container;

a consumer side opposing the container side and facing a consumer during use;

a fastening portion running about the lid axis in a circumferential direction, the fastening portion being configured to be fixed to the container edge and defining a reference plane;

a drinking opening which, in an unused new state of the lid, is closed by a tab that is movable relative to the remaining lid;

a projecting edge radially within the fastening portion, the projecting edge projecting axially away from the reference plane toward the consumer side, the projecting edge being provided at least in a circumferential region in which the drinking opening is also provided; and a lid face radially within the projecting edge, the lid face being set back axially toward the container side with respect to the projecting edge;

wherein the lid face is inclined with respect to the reference plane along a diametric strip of the lid face containing the drinking opening and a nose tip receiving region, the nose tip receiving region being diametrically opposed to the drinking opening and being set back axially with respect to the drinking opening in the direction of the container side;

wherein the drinking opening and the tab are dimensioned and arranged in such a way that the nose tip receiving region, even when the drinking opening is opened in accordance with intended use, remains uncovered by the tab on the consumer side.

2. The beverage container lid according to claim 1, wherein the drinking opening is configured in the lid face.

3. The beverage container lid according to claim 1, wherein the lid face is level.

4. The beverage container lid according to claim 1, wherein the lid face is situated in the nose tip receiving region on a different side of the reference plane from the drinking opening.

5. The beverage container lid according to claim 1, wherein the lid face, with respect to the reference plane, has an incline of between about 8° and about 20°.

6. The beverage container lid according to claim 1, wherein the tab can be folded about a hinge axis between a closing position, in which the tab closes the drinking opening, and an open position, in which the tab frees the drinking opening for axial through-flow, the tab being fixable in its open position on the lid face.

7. The beverage container lid according to claim 6, wherein the hinge axis runs orthogonally with respect to a section line of a section plane, which passes through the drinking opening in its circumferential centre and contains the lid axis, with the lid face.

8. The beverage container lid according to claim 7, wherein the maximum distance of an edge of the drinking opening from the hinge axis and the maximum distance of an edge of the tab from the hinge axis are in total more than two fifths, but less than two thirds, of the dimension of the lid face along the section line, the hinge axis being provided in such a way that it crosses the section line in a region of a fifth to a third of the length of the section line.

9. The beverage container lid according claim 1, wherein the drinking opening has a larger dimension in the circumferential direction than in the radial direction.

10. The beverage container lid according to claim 1, wherein the projecting edge is also configured in a region diametrically opposing the drinking opening and runs completely about the lid axis, wherein, at the circumferential site of the greatest axial spacing of the lid face from the drinking opening, an inner wall running from an apex of the projecting edge to the lid face encloses an angle with the lid face of between about 90° and about 110°.

11. The beverage container lid according claim 10, wherein the projecting edge is also configured in a circumferential region diametrically opposing the drinking opening and runs completely about the lid axis, the spacing of the projecting edge from the reference plane in the circumferential region of the drinking opening being greater than in the circumferential region diametrically opposing the drinking opening, the spacing of the projecting edge from the reference plane being maximal in the circumferential region of the drinking opening and being minimal in the circumferential region diametrically opposing the drinking opening.

12. The beverage container lid according to claim 10, wherein the projecting edge is also configured in a circumferential region diametrically opposing the drinking opening and runs completely about the lid axis, the spacing of the projecting edge from the lid face being smaller in the circumferential region of the drinking opening than in the circumferential region diametrically opposing the drinking opening, the spacing of the projecting edge from the lid face being minimal in the circumferential region of the drinking opening and being maximal in the circumferential region diametrically opposing the drinking opening.

13. The beverage container lid according to claim 1, wherein the projecting edge in the circumferential region of the drinking opening, in a direction orthogonal to the circumferential direction, has a radius of curvature of between about 0.5 mm and about 2 mm.

14. The beverage container lid according to claim 1, wherein the fastening portion is configured to surround the container edge on two sides, radially outwardly and axially, wherein a portion of the fastening portion axially opposes the container edge when the lid is placed on a container.

15. The beverage container lid according to claim 1, wherein provided radially within the projecting edge is a flat face that is parallel to the reference plane and in which the drinking opening is provided, and wherein the inclined lid face is provided adjoining the flat face.

16. The beverage container lid according to claim 1, wherein the lid face is formed from a plurality of part lid faces, which, with respect to the reference plane, have a different incline.

17. The beverage container lid according to claim 15, where the lid face adjoins the flat face along a bend axis, which is parallel to a hinge axis about which hinge axis the tab can be folded between a closing position and an open position.

18. The beverage container lid according to claim 16, wherein the part lid faces adjoin one another along angling axes, which are parallel to at least one of a bend axis and a hinge axis about which the tab can be folded between a closing position and an open position.

* * * * *